US006639575B1

(12) United States Patent
Tsunashima et al.

(10) Patent No.: US 6,639,575 B1
(45) Date of Patent: Oct. 28, 2003

(54) LIQUID CRYSTAL DISPLAY

(75) Inventors: Takanori Tsunashima, Fukaya (JP); Yoshiro Aoki, Kitamoto (JP); Kazuo Nakamura, Kitamoto (JP); Hajime Sato, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/531,162

(22) Filed: Mar. 17, 2000

(30) Foreign Application Priority Data

Mar. 18, 1999 (JP) ..... 11-074137

(51) Int. Cl.[7] ..... G09G 3/36

(52) U.S. Cl. ..... 345/92; 345/87; 345/88; 345/89; 345/98; 345/93; 257/66; 257/72; 257/204; 257/250; 257/347; 257/350; 257/31; 257/387; 257/401

(58) Field of Search ..... 345/92, 93, 87, 345/88, 89, 98; 257/347, 66, 72, 350, 351, 204, 250, 387, 401

(56) References Cited

U.S. PATENT DOCUMENTS 5,714,771 A 2/1998 Misawa et al.
5,973,363 A * 10/1999 Staab et al. ..... 257/347
6,121,806 A * 9/2000 Kono et al. ..... 327/205
6,157,361 A * 12/2000 Kubota et al. ..... 345/100
6,307,236 B1 * 10/2001 Matsuzaki et al. ..... 257/392

* cited by examiner

*Primary Examiner*—Richard Hjerpe
*Assistant Examiner*—Jean Lesperance
(74) *Attorney, Agent, or Firm*—Oblon, Spivak, McClelland, Maier & Neustadt, P.C.

(57) ABSTRACT

There is provided a driving circuit including active matrix type liquid crystal display capable of decreasing the electric power consumption of CMOS buffers contained in a scanning line driving circuit and picture signal line driving circuit. The liquid crystal display has an active matrix type liquid crystal display elements comprising switching elements connected to a plurality of scanning lines and a plurality of picture signal lines perpendicular to the scanning lines. The liquid crystal display includes a digital circuit wherein at least one of a scanning line driving circuit for applying a scanning pulse to the switching elements via the scanning lines and a picture signal line driving circuit for applying a picture signal to the picture signal lines comprises one stage of CMOS buffer or a plurality of CMOS buffers connected in multi stages, the CMOS transistor or each of the CMOS transistors including an N-type thin-film transistor and P-type thin-film transistor which are formed on the same substrate. In the liquid crystal display, one transistor, which has a longer off-state time during operation of the circuit, of the N-type thin-film transistor and P-type thin-film transistor constituting the CMOS buffer, has a longer gate length than that of the other transistor.

12 Claims, 5 Drawing Sheets

| | | GATE LENGTH μm | GATE WIDTH μm |
|---|---|---|---|
| INVERTER 11 | PMOS 14 | $L_1=5$ | $W_1=10$ |
| | NMOS 15 | $L_2=10$ | |
| INVERTER 12 | PMOS 16 | $L_2=10$ | $W_2=50$ |
| | NMOS 17 | $L_1=5$ | |
| INVERTER 13 | PMOS 18 | $L_1=5$ | $W_3=200$ |
| | NMOS 19 | $L_2=10$ | |

| | | GATE LENGTH μm | GATE WIDTH μm |
|---|---|---|---|
| INVERTER 11 | PMOS 14 | L =5 | $W_1$=10 |
| | NMOS 15 | | $W_2$=5 |
| INVERTER 12 | PMOS 16 | L =5 | $W_3$=25 |
| | NMOS 17 | | $W_4$=50 |
| INVERTER 13 | PMOS 18 | L =5 | $W_5$=200 |
| | NMOS 19 | | $W_6$=100 |

LIQUID CRYSTAL DISPLAY

BACKGROUND OF THE INVENTION

1. Field of the Invention

The present invention relates generally to an active matrix type liquid crystal display wherein switching elements serving as active elements are connected to a plurality of scanning lines and a plurality of picture signal lines perpendicular thereto.

2. Related Background Art

Liquid crystal displays of this type are widely used as graphic displays for use in information equipment terminals and thin type televisions. Particularly, in recent years, in order to increase the usual picture area on a transparent insulating substrate of the same area and in order to decrease producing costs, there has been developed a driving circuit including active matrix type liquid crystal display wherein a scanning line driving circuit and a picture signal line driving circuit are integrally formed on a transparent insulating substrate similar to picture element thin-film transistors.

The scanning line driving circuit and picture signal line driving circuit, which are integrally formed on the transparent insulating substrate, include a digital circuit which includes thin-film transistors of a polysilicon as basic elements and which includes one stage of CMOS buffer comprising an N-type thin-film transistor and a P-type thin-film transistor formed on the same substrate or a plurality of CMOS buffers connected in multi stages. In these CMOS buffers, for example, a CMOS transistor is connected so as to serve as an inverter. In addition, a pulse voltage having a duty ratio of about one-tenths through about one-thousandths is applied as an input signals, and the output signal thereof is applied to the scanning lines and the picture signal lines.

In the above described driving circuit including active matrix type liquid crystal display, it is known that the thin-film transistors serving as the basic elements of the driving circuit integrally formed on the transparent substrate are inferior to transistors using a mono-crystalline silicon substrates in capability. In order to explain an example thereof, FIG. 8 shows the relationship between a gate voltage $V_g$ and a drain current $I_d$. As shown in this figure, when the gate voltage $V_g$ is 0V, the variation in the drain current $I_d$ caused by a slight difference in a producing process is great as shown by a width Δ. In order to compensate such characteristics, it is required to increase a gate width to facilitate the flow of currents. Therefore, there is a problem in that the electric power consumption of each element increases in accordance with the increase of leak currents if the gate width is increased.

SUMMARY OF THE INVENTION

It is therefore an object of the present invention to eliminate the aforementioned problems and to provide a driving circuit including active matrix type capable of decreasing the leak currents of thin-film transistors forming CMOS buffers, which are included in a scanning line driving circuit and/or a picture signal line driving circuit, to reduce electric power consumption.

In order to accomplish the aforementioned and other objects, according to one aspect of the present invention, there is provided a liquid crystal display having active matrix type liquid crystal display elements comprising switching elements connected to a plurality of scanning lines and a plurality of picture signal lines perpendicular to the scanning lines, the liquid crystal display including a scanning line driving circuit and a picture signal line driving circuit, the scanning line driving circuit applying a scanning pulse to said switching elements via the scanning lines and the picture signal line driving circuit applying a picture signal to the picture signal lines, at least one of the scanning line driving circuit and the picture signal line driving circuit comprising a digital circuit, the digital circuit comprising one stage of CMOS buffer or a plurality of CMOS buffers connected in multi stages, the CMOS buffer or each of the CMOS buffers including an N-type thin-film transistor and P-type thin-film transistor which are formed on the same substrate, wherein one transistor, which has a longer off-state time during operation of the circuit, of the N-type thin-film transistor and P-type thin-film transistor constituting the CMOS buffer, has a longer gate length than that of the other transistor.

According to another aspect of the present invention, there is provided a liquid crystal display having active matrix type liquid crystal display elements comprising switching elements connected to a plurality of scanning lines and a plurality of picture signal lines perpendicular to the scanning lines, the liquid crystal display including a scanning line driving circuit and a picture signal line driving circuit, the scanning line driving circuit applying a scanning pulse to the switching elements via the scanning lines and the picture signal line driving circuit applying a picture signal to the picture signal lines, at least one of the scanning line driving circuit and the picture signal line driving circuit comprising a digital circuit, the digital circuit comprising one stage of CMOS buffer or a plurality of CMOS buffers connected in multi stages, the CMOS buffer or each of the CMOS buffers including an N-type thin-film transistor and P-type thin-film transistor which are formed on the same substrate, wherein one transistor, which has a longer off-state time during operation of the circuit, of the N-type thin-film transistor and P-type thin-film transistor constituting the CMOS buffer, has a narrower gate width than that of the other transistor.

According to a further aspect of the present invention, there is provided a liquid crystal display having active matrix type liquid crystal display elements comprising switching elements connected to a plurality of scanning lines and a plurality of picture signal lines perpendicular to the scanning lines, the liquid crystal display including a scanning line driving circuit and a picture signal line driving circuit, the scanning line driving circuit applying a scanning pulse to the switching elements via the scanning lines and the picture signal line driving circuit applying a picture signal to the picture signal lines, at least one of the scanning line driving circuit and the picture signal line driving circuit comprising a digital circuit, the digital circuit comprising one stage of CMOS buffer or a plurality of CMOS buffers connected in multi stages, the CMOS buffer or each of the CMOS buffers including an N-type thin-film transistor and P-type thin-film transistor which are formed on the same substrate, wherein one transistor, which has a longer off-state time during operation of the circuit, of the N-type thin-film transistor and P-type thin-film transistor constituting the CMOS buffer, has a longer gate length than that of the other transistor, and the one transistor has a narrower gate width than that of the other transistor.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of the present invention will be described below.

Figure 1:
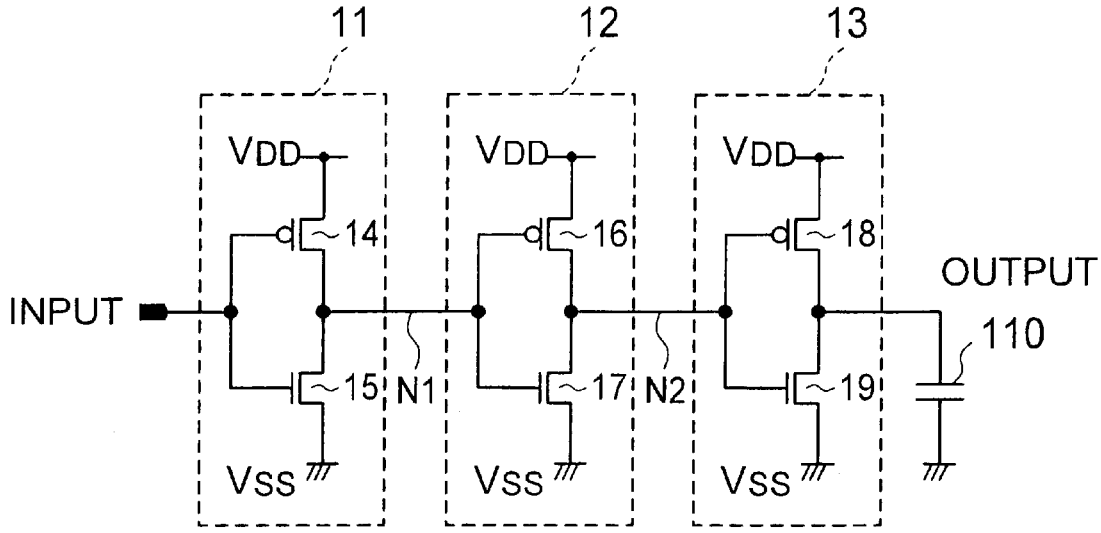
FIG. 1 is a circuit diagram of a digital circuit incorporated as a component of at least one of a scanning line driving circuit and picture signal line driving circuit of a liquid crystal display according to the present invention.

FIG. 1 is a circuit diagram showing a partial construction of a liquid crystal display according to the present invention, which shows a digital circuit incorporated as a component of at least one (usually both) of a scanning line driving circuit and a picture signal line driving circuit. In this digital circuit, three inverters 11, 12 and 13 are connected in series. As these inverters 10 11, 12 and 13, CMOS transistors are used.

That is, the inverter 11 comprises a PMOS transistor 14 for forming a source/drain path between a high-voltage power supply $V_{DD}$ and a node N1, and an NMOS transistor 15 for forming a source/drain path between a low-voltage power supply $V_{SS}$, which is shown as a ground point, and the node N1. The gates of these transistors are connected to each other and connected to a logic signal input terminal. The inverter 12 comprises a PMOS transistor 16 for forming a source/drain path between the high-voltage power supply $V_{DD}$ and a node N2, and an NMOS transistor 17 for forming a source/drain path between the low-voltage power supply $V_{SS}$ and the node N2. The gates of these transistors are connected to each other and connected to the node N1. The inverter 13 comprises a PMOS transistor 18 for forming a source/drain path between the high-voltage power supply $V_{DD}$ and a logic signal output end, and an NMOS transistor 19 for forming a source/drain path between the low-voltage power supply $V_{SS}$ and the output end. The gates of these transistors are connected to each other and connected to the node N2. Between the logic signal output end and the low-voltage power supply $V_{SS}$, a capacitive load 110 is provided.

Figure 2:
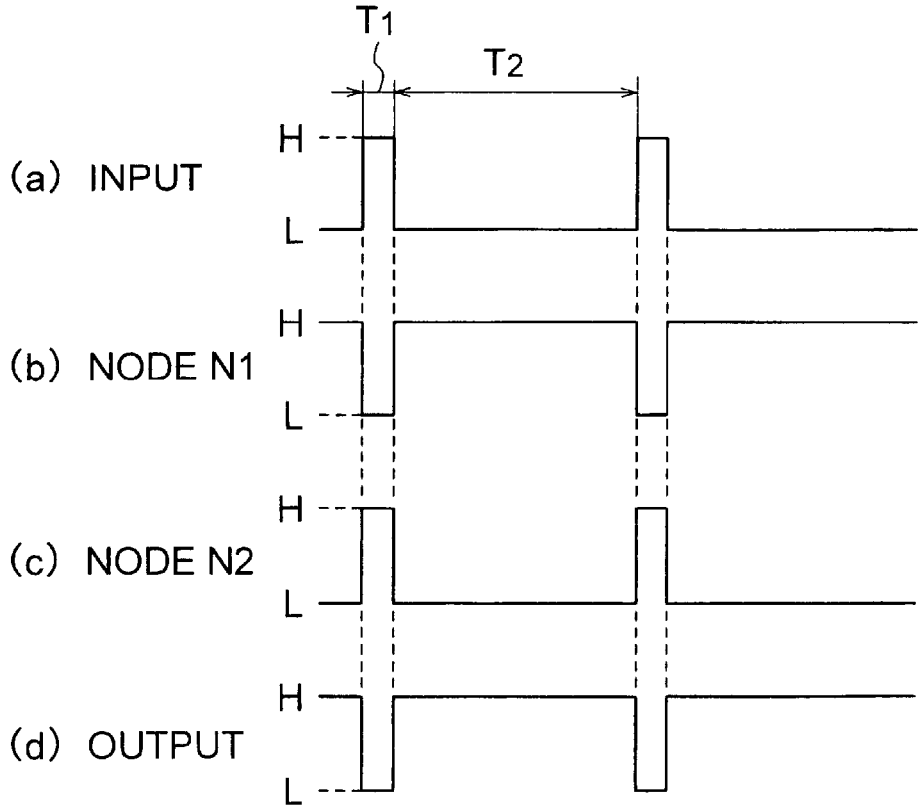
FIG. 2 is a diagram showing a signal waveform of a principal part corresponding to an input signal of the digital circuit shown in FIG. 1.

As shown in FIG. 2(*a*), if a pulse voltage, which has a duty ratio of one-tenths to one-thousandths, an H-level time of T1 and a L-level time of T2, is applied to the logic signal input end of the digital circuit shown in FIG. 1, the voltage waveform at the node N1 is an inverted waveform as shown in FIG. 2(*b*). In addition, the voltage waveform at the node N2 is returned so as to be the same waveform as the input voltage waveform as shown in FIG. 2(*c*), and the output voltage waveform is a waveform obtained by inverting the voltage waveform at the node N2 as shown in FIG. 2(*d*).

In this case, the PMOS transistor 14 of the inverter 11 remains being turned off for the time T1, and turned on for the time T2 which is far longer than the time T1. On the other hand, the NMOS transistor 15 remains being turned on for the time T1 and turned off for the time T2. Therefore, during the operation of the digital circuit shown in FIG. 1, the off time of the NMOS transistor 15 is far longer than the off time of the PMOS transistor 14. In the inverter 12, the off time of the PMOS transistor 16 is far longer than the off time of the NMOS transistor 17. In the inverter 13, the off time of the NMOS transistor 19 is far longer than the off time of the PMOS transistor 18.

As described above, if the transistors 14 through 19 are formed of thin-film transistors, the leak currents thereof increase as the gate widths thereof increase. In this preferred embodiment, among the CMOS transistors constituting the inverters 11, 12 and 13, the gate length of a transistor mainly remaining in the off state is increased, or the gate width of the transistor is decreased, so that the leak currents are reduced to decrease electric power consumption.

Figure 3:
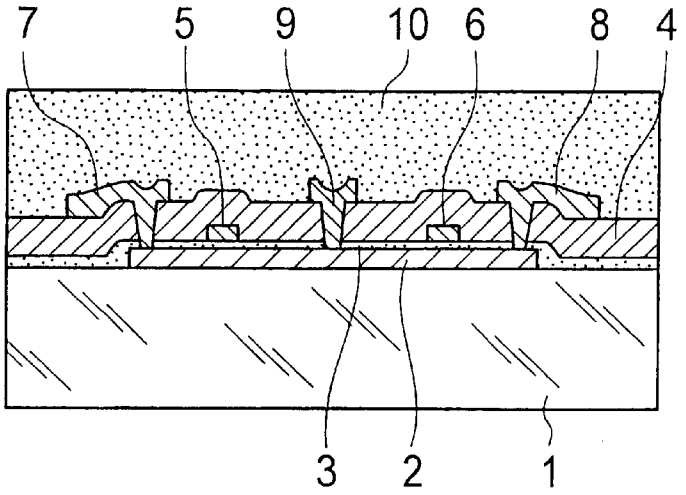
FIG. 3(*a*) is a sectional view showing the detailed construction of the first preferred embodiment of the digital circuit shown in FIG. 1, and FIG. 3(*b*) is a plan view thereof.
Figure 3:
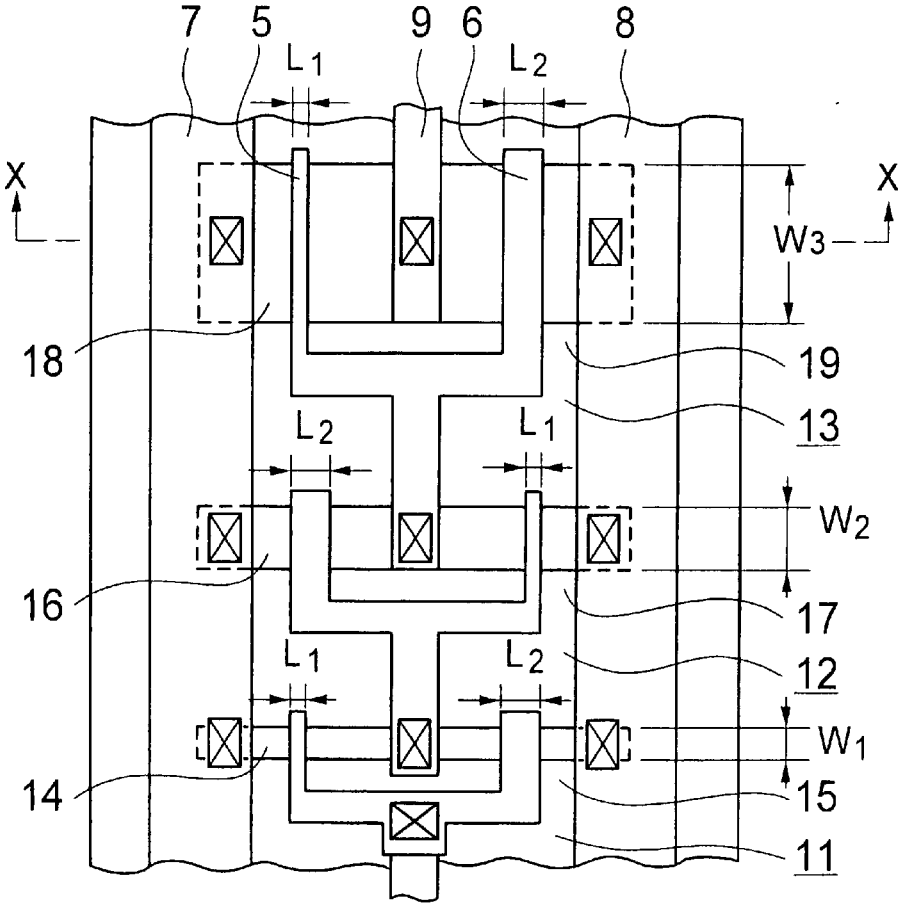

FIGS. 3(*a*) and 3(*b*) are sectional and plan views showing the detailed construction of the first preferred embodiment of a digital circuit according to the present invention, which is formed in accordance with the above described consideration. In order to facilitate better understanding thereof, the interlayer insulating film and insulating layer shown in the sectional view of FIG. 3(*a*) are omitted from the plan view of FIG. 3(*b*). In these figures, a polysilicon layer 2 is formed on a glass substrate 1. Then, a well-known treatment for forming a CMOS transistor of a PMOS transistor 18 and NMOS transistor 19 on the polysilicon layer 2 is carried out. Then, a gate insulating film 3 is formed on the polysilicon layer 2, and gates 5 and 6 are formed thereon so as to be spaced from each other. Then, an interlayer insulating film 4 is formed on the gate insulating film 3 including the gates 5 and 6, and a high-voltage power supply wiring 7 and a low-voltage power supply wiring 8 are formed thereon. In addition, a signal wiring 9 is formed on the interlayer insulating film 4 between the gates 5 and 6.

Then, the high-voltage power supply wiring 7, the low-voltage power supply wiring 8 and the logic signal output wiring 9 are connected to the polysilicon layer 2 in predetermined regions via through holes formed in the interlayer insulating film 4, respectively. Furthermore, the gates 5 and 6 correspond to the tip portions of a substantially U-shaped wiring, the base portion of which is connected to the logic signal output wiring of the CMOS transistor in the front stage. An insulating layer 10 is stacked on the surface of the interlayer insulating film 4 including the surfaces of the high-voltage power supply wiring 7, the low-voltage power supply wiring 8 and the logic signal output wiring 9. Thus, the PMOS transistor 18 and the NMOS transistor 19 are connected in series, and both ends thereof are connected to the high-voltage power supply wiring 7 and the low-voltage power supply wiring 8, so that an inverter 13 for outputting a signal from the signal wiring 9 is obtained. Similar to the inverter 13, inverters 11 and 12 are obtained.

Figures 4, 5:
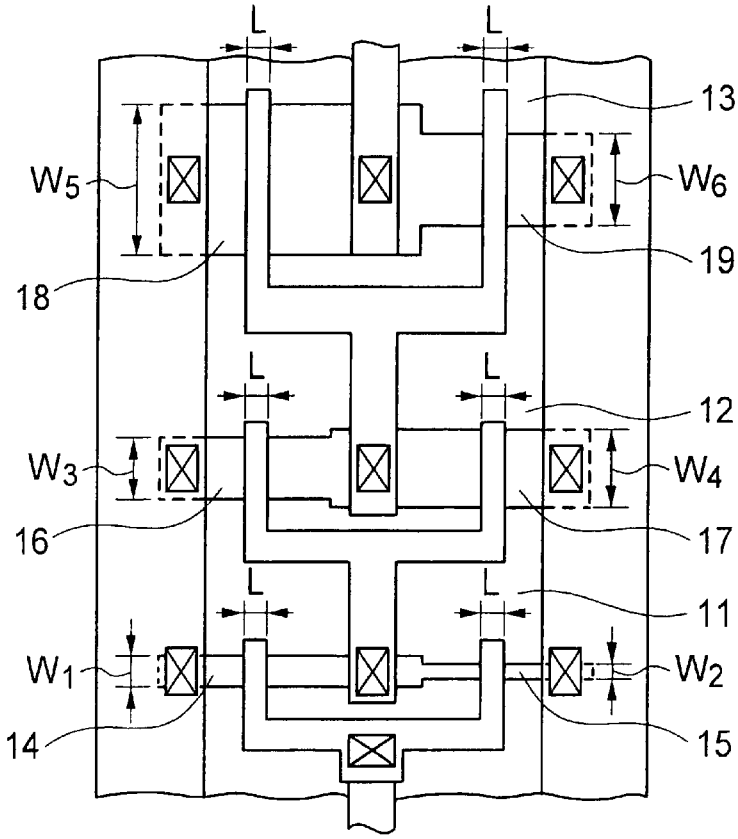
FIG. 4 is a table showing the detailed dimensions of a principal part of the first preferred embodiment of the digital circuit shown in FIG. 3.
FIG. 5 is a plan view showing the detailed construction of the second preferred embodiment of the digital circuit shown in FIG. 1.

By the way, the inverters 11, 12 and 13 are formed so as to increase the current capacities thereof. Assuming that the gate width of each of the PMOS transistor 14 and NMOS transistor 15 constituting the inverter 11 is $W_1$, the gate width of each of the PMOS transistor 16 and NMOS transistor 17 constituting the inverter 12 is $W_2$, and the gate width of each of the PMOS transistor 18 and NMOS transistor 19 constituting the inverter 13 is $W_3$, then there is established the relationship of $W_1<W_2<W_3$. As an example of approximate values, $W_1=10\ \mu m$, $W_2=50\ \mu m$ and $W_3=200\ \mu m$ are shown in FIG. 4. Furthermore, since it is difficult to express these dimensional differences, scales are changed in FIG. 3.

On the other hand, assuming that the gate length of the PMOS transistor 14 of the inverter 11 is $L_1$, and the gate length of the NMOS transistor 15 of the inverter 11 is $L_2$, then the respective lengths are determined so that $L_1<L_2$. In addition, the gate length of the PMOS transistor 16 of the inverter 12 is formed to be $L_2$, and the gate length of the NMOS transistor of the inverter 12 is formed to be $L_1$. Moreover, the gate length of the PMOS transistor 18 of the inverter 13 is formed to be $L_1$, and the gate length of the NMOS transistor 19 of the inverter 13 is formed to be $L_2$. As an example of appropriate values, $L_1=5\ \mu m$ and $L_2=10\ \mu m$ are shown in FIG. 4.

Taking notice of the inverter 11, the off time of the NMOS transistor 15 is far longer than the off time of the PMOS transistor 14. In this preferred embodiment, the gate length $L_2$ of the NMOS transistor 15 having a longer off-state time is set to be longer than the gate length $L_1$ of the PMOS transistor 14, so that it is possible to reduce the leak current of the transistor operating in the pulse voltage wavelength shown in FIG. 2. Similarly, in the inverter 12, the gate length $L_2$ of the PMOS transistor 16 having a longer off-state time is set to be longer than the gate length $L_1$ of the NMOS transistor 17, so that it is possible to reduce the leak current thereof. Also in the inverter 13, the gate length $L_2$ of the NMOS transistor 19 having a longer off-state time is set to be longer than the gate length $L_1$ of the PMOS transistor 18, so that it is possible to reduce the leak current thereof.

As a result, as shown in FIG. 1, the electric power consumption of a digital circuit comprising a plurality of CMOS buffers connected in multi stages can be far smaller than that of a similar digital circuit for use in a conventional liquid crystal display.

FIG. 5 is a plan view showing the detailed construction of the second preferred embodiment of a digital circuit constituting a liquid crystal display according to the present invention. In this figure, the same reference numbers are used for the same elements as those in FIG. 3 showing the first preferred embodiment, and the descriptions thereof are omitted.

In this preferred embodiment, the gate width of one transistor having a longer off-state time of two transistors constituting a CMOS buffer is formed to be narrower than the gate width of the other transistor. That is, in the inverter 11, the gate width $W_2$ of the NMOS transistor 15 is set to be narrower than the gate width $W_1$ of the PMOS transistor 14. In the inverter 12, the gate width $W_3$ of the PMOS transistor 16 is set to be narrower than the gate width $W_4$ of the NMOS transistor 17, and in the inverter 13, the gate width $W_6$ of the NMOS transistor 17 is set to be narrower than the gate width $W_5$ of the PMOS transistor 18. In this case, the gate lengths L of the respective MOS transistors are set to be equal to each other. An example of these approximate values is shown in the table of FIG. 6.

As a result, as shown in FIG. 1, the electric power consumption of a digital circuit comprising a plurality of CMOS buffers connected in multi stages can be far smaller than that of a similar digital circuit for use in a conventional liquid crystal display.

Figures 6, 7:
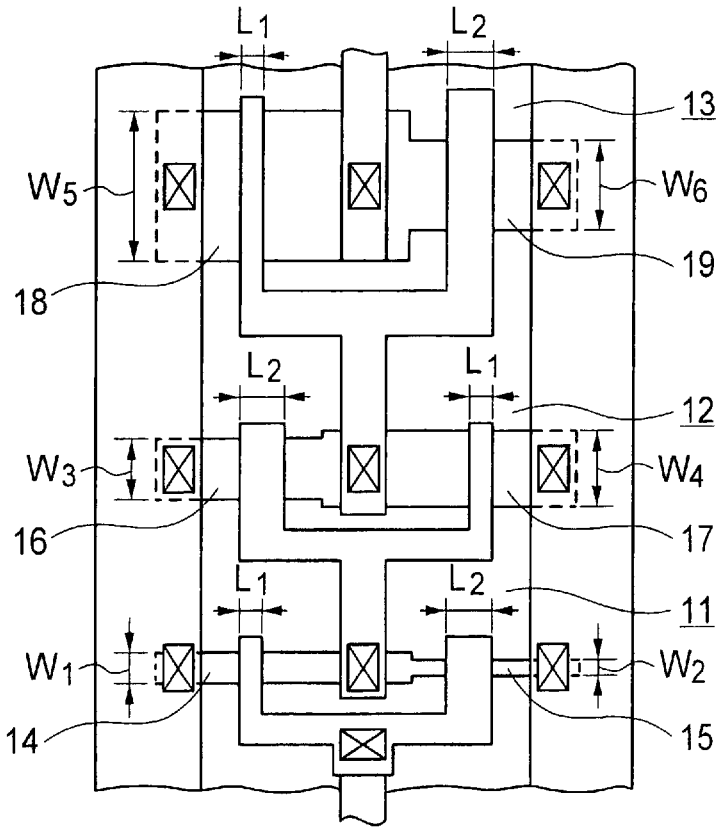
FIG. 6 is a table showing the detailed dimensions of a principal part of the second preferred embodiment of the digital circuit shown in FIG. 3.
FIG. 7 is a plan view showing the detailed construction of the third preferred embodiment of the digital circuit shown in FIG. 1.
Figure 8:
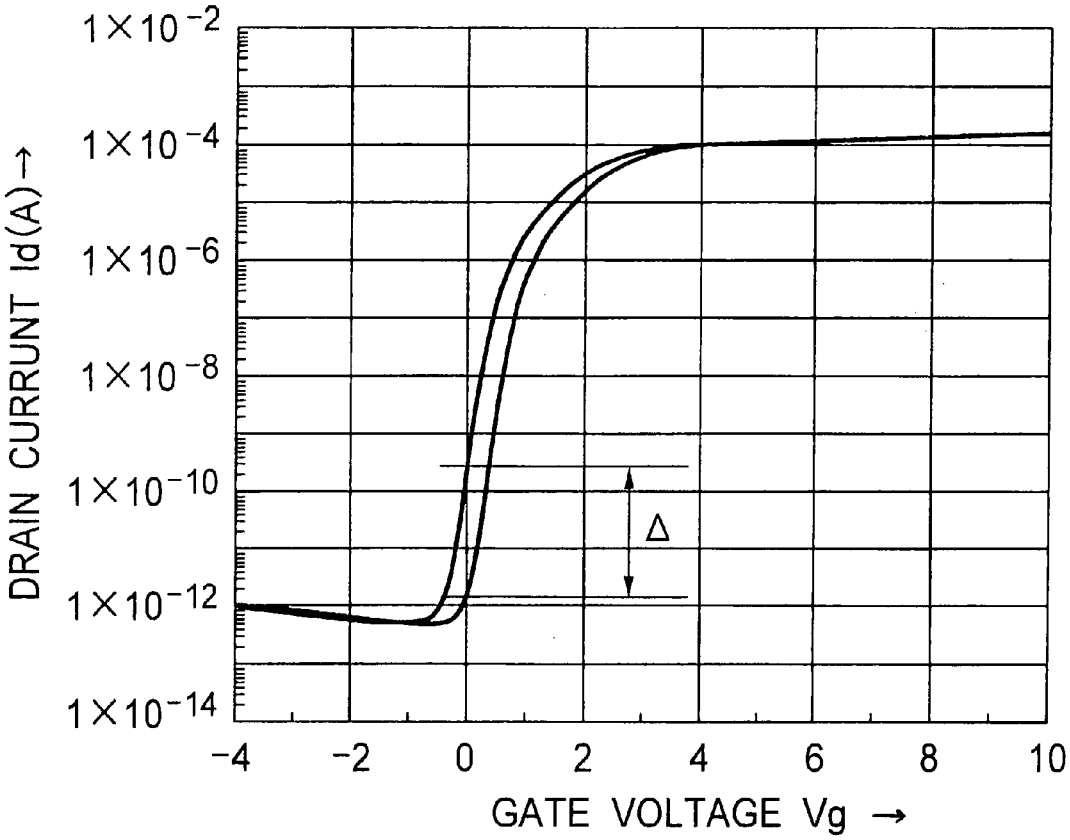
FIG. 8 is a graph showing the relationship between a drain current and a gate voltage for explaining the performance of a thin-film transistor.

FIG. 7 is a plan view showing the detailed construction of the third preferred embodiment of a digital circuit constituting a liquid crystal display according to the present invention. In this figure, the same reference numbers are used for the same elements as those in FIG. 3 showing the first preferred embodiment or FIG. 5 showing the second preferred embodiment, and the descriptions thereof are omitted.

In this preferred embodiment, the gate length of one transistor having a longer off-state time of two transistors constituting a CMOS buffer is formed to be longer than the gate length of the other transistor, and the gate width of the one transistor having the longer off-state time is formed to be narrower than the gate width of the other transistor, so as to reduce leak currents. That is, in the inverter 11, when the gate length and gate width of the PMOS transistor 14 are formed to be $L_1$ and $W_1$, respectively, the NMOS transistor 15 is formed so as to have a longer gate length of $L_2$ and a narrower gate width of $W_2$. Similarly, in the inverter 12, when the gate length and gate width of the NMOS transistor 17 are formed to be $L_1$ and $W_1$, respectively, the PMOS transistor 16 is formed so as to have a longer gate length $L_2$ and a narrower gate width $W_3$. In addition, in the inverter 13, when the gate length and gate width of the PMOS transistor 18 are formed to be $L_1$ and $W_5$, respectively, the NMOS transistor 19 is formed so as to have a longer gate length of $L_2$ and a narrower gate width of $W_6$.

Furthermore, in the third preferred embodiment shown in FIG. 7, the differences between the gate lengths and gate widths of a pair of PMOS and NMOS transistors constituting each of the inverters 11, 12 and 13 should not be limited to the values shown in FIG. 4 or 6, but design may be suitably changed without obstructing operation.

Therefore, as shown in FIG. 1, the electric power consumption of a digital circuit comprising a plurality of CMOS buffers connected in multi stages can be far smaller than that of a similar digital circuit for use in a conventional liquid crystal display.

Furthermore, while the CMOS buffer has comprised the inverter in the above described preferred embodiment, the CMOS buffer may comprise a circuit carrying out the same operation, e.g., a NAND circuit or a NOR circuit.

In addition, while the thin-film transistor has formed of a polysilicon in the above described preferred embodiment, the thin-film transistor may be formed of a micro crystal or an amorphous silicon.

As can be clearly seen from the foregoing, according to the present invention, it is possible to provide a driving circuit including active matrix type liquid crystal display capable of reducing electric power consumption by decreasing leak currents by increasing the gate length of one transistor having a longer off-state time and/or decreasing the gate width thereof, of a pair of transistors constituting a CMOS buffer, during the operation of a driving circuit.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A liquid crystal display having active matrix type liquid crystal display elements comprising switching elements connected to a plurality of scanning lines and a plurality of picture signal lines perpendicular to said scanning lines, said liquid crystal display including a scanning line driving circuit and a picture signal line driving circuit, said scanning line driving circuit applying a scanning pulse to said switching elements via said scanning lines and said picture signal line driving circuit applying a picture signal to said picture signal lines, at least one of said scanning line driving circuit and said picture signal line driving circuit comprising a digital circuit, said digital circuit comprising one stage of CMOS buffer or a plurality of CMOS buffers connected in multi stages, said CMOS buffer or each of said CMOS buffers including an N-type thin-film transistor and P-type thin-film transistor which are formed on the same substrate, wherein one transistor, which has a longer off-state time during operation of the circuit, of said N-type thin-film transistor and P-type thin-film transistor constituting said CMOS buffer, has a longer gate length than that of the other transistor, wherein said digital circuit comprises a plurality of CMOS buffers, said one transistor of each of said CMOS buffers having a gate length of $L_2$, said other transistor of each of said CMOS buffers having a gate length of $L_1$ ($L_2>L_1$), said plurality of CMOS buffers being arranged so that the gate widths thereof sequentially increase from an upstream side toward a downstream side of signals outputted from said CMOS buffers.

2. A liquid crystal display as set forth in claim 1, wherein said CMOS buffer comprises an inverter.

3. A liquid crystal display as set forth in claim 1, wherein each of said N-type thin-film transistor and P-type thin-film transistor constituting said CMOS transistor is formed of a polysilicon.

4. A liquid crystal display having active matrix type liquid crystal display elements comprising switching elements connected to a plurality of scanning lines and a plurality of picture signal lines perpendicular to said scanning lines, said liquid crystal display including a scanning line driving circuit and a picture signal line driving circuit, said scanning line driving circuit applying a scanning pulse to said switching elements via said scanning lines and said picture signal line driving circuit applying a picture signal to said picture signal lines, at least one of said scanning line driving circuit and said picture signal line driving circuit comprising a digital circuit, said digital circuit comprising one stage of CMOS buffer or a plurality of CMOS buffers connected in multi stages, said CMOS buffer or each of said CMOS buffers including an N-type thin-film transistor and P-type thin-film transistor which are formed on the same substrate, wherein one transistor, which has a longer off-state time during operation of the circuit, of said N-type thin-film transistor and P-type thin-film transistor constituting said CMOS buffer, has a narrower gate width than that of the other transistor, and wherein said digital circuit comprises a plurality of CMOS buffers, said one transistor of each of said CMOS buffers having a gate length of $L_2$, said other transistor of each of said CMOS buffers having a gate length of $L_1$ ($L_2>L_1$), said one transistor of a downstream side one of said CMOS buffers having a gate width which is set to be greater than that of said one transistor of an upstream side one of said CMOS buffers, and said gate width of said other transistor of said downstream side one of said CMOS buffers being set to be greater than that of said other transistor of said upstream side one of said CMOS buffers.

5. A liquid crystal display as set forth in claim 4, wherein said CMOS buffer comprises an inverter.

6. A liquid crystal display as set forth in claim 4, wherein each of said N-type thin-film transistor and P-type thin-film transistor constituting said CMOS transistor is formed of a polysilicon.

7. A liquid crystal display having active matrix type liquid crystal display elements comprising switching elements connected to a plurality of scanning lines and a plurality of picture signal lines perpendicular to said scanning lines, said liquid crystal and a plurality of picture signal lines perpendicular to said scanning lines, said liquid crystal display including a scanning line driving circuit and a picture signal line driving circuit, said scanning line driving circuit applying a scanning pulse to said switching elements via said scanning lines and said picture signal line driving circuit applying a picture signal to said picture signal lines, at least one of said scanning line driving circuit and said picture signal line driving circuit comprising a digital circuit, said digital circuit comprising one stage of CMOS buffer or a plurality of CMOS buffers connected in multi stages, said CMOS buffer or each of said CMOS buffers including an N-type thin-film transistor and P-type thin-film transistor which are formed on the same substrate, wherein, one transistor, which has a longer off-state time during operation of the circuit, of said N-type thin-film transistor and P-type thin-film transistor constituting said CMOS buffer, has a longer gate length than that of the other transistor, and said one transistor has a narrower gate width than that of said other transistor, wherein said digital circuit comprises a plurality of CMOS buffers, said one transistor of a downstream side one of said CMOS buffers having a gate width which is set to be greater than that of said one transistor of an upstream side one of said CMOS buffers, and said gate width of said other transistor of said downstream side one of said CMOS buffers being set to be greater than that of said other transistor of said upstream side one of said CMOS buffers.

8. A liquid crystal display as set forth in claim 7, wherein said CMOS buffer comprises an inverter.

9. A liquid crystal display as set forth in claim 7, wherein each of said N-type thin-film transistor and P-type thin-film transistor constituting said CMOS transistor is formed of a polysilicon.

10. A liquid crystal display having active matrix type liquid crystal display elements comprising switching elements connected to a plurality of scanning lines and a plurality of picture signal lines perpendicular to said scanning lines, said liquid crystal display including a scanning line driving circuit and a picture signal line driving circuit, said scanning line driving circuit applying a scanning pulse to said switching elements via said scanning lines and said picture signal line driving circuit applying a picture signal to said picture signal lines, at least one of said scanning line driving circuit and said picture signal line driving circuit comprising a digital circuit, said digital circuit comprising one stage of CMOS buffer or a plurality of CMOS buffers connected in multi stages, said CMOS buffer or each of said CMOS buffers including an N-type thin-film transistor and P-type thin-film transistor which are formed on the same substrate, wherein one transistor, which has a longer off-state time during operation of the circuit, of said N-type thin-film transistor and P-type thin-film transistor constituting said CMOS buffer, has a narrower gate width than that of the other transistor, and wherein said digital circuit comprises a plurality of CMOS buffers, said one transistor of each of said CMOS buffers having the same gate length as that of said other transistor of a corresponding one of said CMOS buffers.

11. A liquid crystal display as set forth in claim 10, wherein said CMOS buffer comprises an inverter.

12. A liquid crystal display as set forth in claim 10, wherein each of said N-type thin-film transistor and P-type thin-film transistor constituting said CMOS transistor is formed of a polysilicon.

* * * * *